US011042123B2

(12) United States Patent
Rudaz

(10) Patent No.: US 11,042,123 B2
(45) Date of Patent: Jun. 22, 2021

(54) CLOCKWORK MODULE

(71) Applicant: ROLEX SA, Geneva (CH)

(72) Inventor: Denis Rudaz, Segny (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/386,918

(22) Filed: Dec. 21, 2016

(65) Prior Publication Data

US 2017/0185039 A1 Jun. 29, 2017

(30) Foreign Application Priority Data

Dec. 23, 2015 (EP) ..... 15202595

(51) Int. Cl.

| | |
|---|---|
| ***G04B 1/16*** | (2006.01) |
| ***G04B 27/04*** | (2006.01) |
| ***G04B 3/04*** | (2006.01) |
| ***G04B 11/00*** | (2006.01) |
| ***G04B 15/00*** | (2006.01) |
| ***G04B 37/00*** | (2006.01) |
| ***G04B 13/02*** | (2006.01) |

(52) U.S. Cl.

CPC ..... *G04B 13/02* (2013.01); *G04B 1/16* (2013.01); *G04B 3/046* (2013.01); *G04B 11/001* (2013.01); *G04B 15/00* (2013.01); *G04B 27/04* (2013.01); *G04B 37/00* (2013.01)

(58) Field of Classification Search

CPC ..... G04B 13/00; G04B 13/02; G04B 13/021; G04B 13/026

See application file for complete search history.

(56) References Cited

U.S. PATENT DOCUMENTS 1,401,390 A * 12/1921 August ..... G04B 19/223 368/27
1,779,707 A * 10/1930 Jarvis ..... G04B 1/225 185/9
2,591,260 A * 4/1952 Hobbs ..... F03G 1/00 185/37
4,459,033 A 7/1984 Cleusix (Continued)

FOREIGN PATENT DOCUMENTS

CH 162188 A 6/1933
CH 241963 A 4/1946

(Continued)

OTHER PUBLICATIONS

Testori, Leondard, English Translation of CH707741, originially published Sep. 15, 2014, retrieved from Espacenet on Jun. 25, 2018, full document.*

(Continued)

*Primary Examiner* — Daniel P Wicklund
(74) *Attorney, Agent, or Firm* — Seckel IP, PLLC

(57) ABSTRACT

A clockwork module (100) including (i) a mobile part (11) including a first functional part and a second functional part (11*a*, 11*b*) and an arbor (15), (ii) a spring (13), (iii) a casing (14) including a housing (140), (iv) a first guide surface (14*a*, 140*a*) in the housing (140), (v) a first stop (140*b*) in the housing, (vi) a second stop (16*b*) arranged on the mobile part (11), the arbor (15) being guided by the first guide surface, the spring being arranged in the housing between the first and second stops.

26 Claims, 7 Drawing Sheets

(56) References Cited

U.S. PATENT DOCUMENTS

| | | | | | |
|---|---|---|---|---|---|
| 5,828,628 | A * | 10/1998 | Born | G04B 9/005 368/66 |
| 2007/0201315 | A1 | 8/2007 | Hirano | |
| 2008/0205200 | A1 | 8/2008 | Spode et al. | |
| 2008/0304370 | A1 | 12/2008 | Scheufele | |
| 2008/0310257 | A1 | 12/2008 | Perret et al. | |
| 2010/0002546 | A1 | 1/2010 | Rochat et al. | |
| 2010/0254230 | A1* | 10/2010 | Takeuchi | C10M 125/02 368/220 |
| 2014/0177397 | A1 | 6/2014 | Rudaz et al. | |
| 2015/0043314 | A1 | 2/2015 | Hiranuma et al. | |

FOREIGN PATENT DOCUMENTS

| | | | | |
|---|---|---|---|---|
| CH | 350249 | A | 11/1960 | |
| CH | 2 015 145 | A1 | 1/2009 | |
| CH | 702 420 | A2 | 6/2011 | |
| CH | 707741 | A2 * | 9/2014 | G04B 5/12 |
| CN | 101276200 | A | 10/2008 | |
| CN | 101324782 | A | 12/2008 | |
| DE | 2354226 | A1 * | 5/1975 | G04B 17/10 |
| DE | 69721741 | T2 | 3/2004 | |
| EP | 0 063 543 | A1 | 10/1982 | |
| EP | 0 884 659 | A1 | 12/1998 | |
| EP | 0884658 | A1 | 12/1998 | |
| EP | 0884658 | B1 | 5/2003 | |
| EP | 1 791 043 | A1 | 5/2007 | |
| EP | 2 133 759 | A1 | 12/2009 | |
| GB | 1165855 | A * | 10/1969 | G04B 27/00 |
| JP | H09-138286 | A | 5/1997 | |
| JP | H10-197653 | A | 7/1998 | |
| JP | 2011-174905 | A | 9/2011 | |
| JP | 2015-036642 | A | 2/2015 | |
| WO | 2012/175595 | A1 | 12/2012 | |

OTHER PUBLICATIONS

European Search Report and Written Opinion dated May 30, 2016 issued in counterpart European application No. 15202595; w/ English partial translation and partial machine translation (18 pages).

Japanese Office Action and Search Report dated Dec. 15, 2020 in counterpart application No. JP2016-248562; w/ English machine translation (33 pages).

Chinese Office Action and Search Report dated Nov. 25, 2019 in counterpart application No. CN201611206012.5; w/ English machine translation (19 pages).

* cited by examiner

CLOCKWORK MODULE

This application claims priority of European patent application No. EP 15202595.3 filed Dec. 23, 2015, the content of which is hereby incorporated by reference herein in its entirety.

The invention relates to a clockwork module. The invention also relates to a clockwork movement including such a module. The invention also relates to a timepiece, in particular a wristwatch, including such a module or such a movement. The invention also relates to a method for manufacturing a clockwork system. The invention finally relates to a clockwork system obtained using such a method.

Clockwork mobile parts are usually designed to cooperate with elastic return means to enable same to be positioned or actuated when performing the different functions of a clockwork movement. These elastic return means are usually springs, in particular leaf springs or wire springs, that are put in place by a watchmaker when assembling the movement. Such positioning operations can be delicate, notably on account of the pre-stressing of the spring, which entails a risk of marking the clockwork mobile part. Furthermore, such springs occupy a significant amount of space, in particular in the plane of the frame of the movement, in relation to the area available inside the clockwork movement. There are alternative designs in which the springs are in the form of washers or metal foils. Nonetheless, assembly of such springs in the movement may be particularly delicate on account of the small size of same.

Patent application EP0063543 discloses a pull-out piece pivoted on an axis, the clearance of which is delimited by a support spring. This spring is formed by the end of a stamped blank. Firstly, this solution is particularly bulky. Secondly, the support spring may damage the visible surface of the pull-out piece, depending on the bearing force generated by the spring.

Patent application EP2133759 describes a vertical clutch device arranged within a time setting train. The clutch device is provided to prevent the hands from being set outside of predetermined periods by an additional striking mechanism. For this purpose, a setting wheel has an outer circular groove engaging with the free end of a leaf spring, the base of which is attached to a frame of the movement and pre-stressed so that the elasticity of the spring pushes the wheel downwards to keep same in the clutched position. Like in the embodiment in the aforementioned document, such a design occupies a significant surface area in the frame of the movement.

Patent application US20070201315 describes a vertical clutch device of a time setting train, which is actuated directly by the time setting stem. A setting wheel, in particular a rotary shaft of the setting wheel, is held in position against the time setting stem by a leaf spring. Like in the solution in the aforementioned document, such a design occupies a significant surface area in the frame of the movement.

Patent application WO2012175595 discloses a vertical clutch device of a manual winding mechanism for a movement, in which a first crown wheel has contrate toothing designed to be pressed against the contrate toothing of a second crown wheel under the effect of a metal foil. This latter is designed to be pre-stressed by the winding bridge during assembly of the mechanism inside the movement. The assembly operations of such a structure may be delicate.

Patent application CH702420 describes a vertical clutch device of a time setting train. The clutch device is actuated directed by the time setting stem. A setting wheel, in particular a rotary shaft of the setting wheel, is held in position against the time setting stem by a helical spring. This latter is designed to be pre-stressed by a blank during assembly of the mechanism inside the movement. The assembly operations of such a structure may be delicate.

The purpose of the invention is to provide a clockwork device to overcome the drawbacks mentioned above and to improve the devices known in the prior art. In particular, the invention proposes a clockwork module with a simple structure, which is therefore reliable. Furthermore, the clockwork module proposed helps to simplify assembly operations.

A clockwork module according to the invention is defined by point 1 as follows:

1. A clockwork module including:
   - a mobile part including a first functional part and/or a second functional part and an arbor, the arbor having a first axis,
   - a spring, notably a helical spring,
   - a casing including a housing having a second axis of translation and/or of rotation of the mobile part,
   - a first guide surface in the housing,
   - a first stop in the housing,
   - a second stop arranged on the mobile part, the arbor being guided by at least the first guide surface, the spring being arranged, notably having been pre-stressed, in the housing between the first and second stops.

Different embodiments of the clockwork module are defined by points 2 to 11 as follows:

2. The module as defined in the preceding point, characterized in that the first functional part includes or is a member acting by translation and/or rotation about the second axis, notably a wheel, a toothed sector, a yoke, a lever, a pull-out piece, a cam and/or in that the second functional part includes or is a shape designed to receive or to transmit a force along the second axis, notably a domed shape of the arbor, a concave shape of the arbor, a throughout cut-out in the arbor, a wheel having toothing designed to transmit a force along the first axis and/or the second axis.

3. The module as defined in one of the preceding points, characterized in that the first axis and the second axis are coaxial or substantially coaxial.

4. The module as defined in one of the preceding points, characterized in that the arbor is integral with the first functional part and/or the second functional part of the mobile part, or attached to the first functional part and/or the second functional part of the mobile part.

5. The module as defined in one of the preceding points, characterized in that the second stop is formed by shaping the arbor, notably by means of a flange integral with the arbor or a ring attached to, and in particular driven into, the arbor.

6. The module as defined in the preceding point, characterized in that the shape has an outer surface cooperating with the first guide surface of the housing.

7. The module as defined in one of the preceding points, characterized in that the housing has a first hole that is blind and a second hole that is open.

8. The module as defined in one of the preceding points, characterized in that the casing includes an attachment element for attaching same to a plate or a bridge, notably an external rotationally symmetrical cylindrical surface of the casing designed to cooperate with a guide and/or driving surface of the plate or of the bridge and/or one or more attachment holes formed in the casing and designed to cooperate with attachment screws or rivets.

9. The module as defined in one of the preceding points, characterized in that it includes a third stop on the casing arranged to stop the mobile part from moving in translation along the second axis.

10. The module as defined in one of the preceding points, characterized in that the casing is a bushing or a bridge.

11. The clockwork module as defined in one of the preceding points, characterized in that it includes:

- n mobile parts, each including a first functional part and/or a second functional part and a translational and/or rotational arbor of the mobile part, the arbor having a first axis,
- n springs, notably n helical springs,
- a single casing including n housings, each having a second axis,
- n first guide surfaces in the housings,
- n first stops in the housings,
- n second stops arranged on the mobile parts, the n arbors being guided by at least the first guide surfaces, the n springs being arranged, notably having been pre-stressed, in the housings between the first and second stops, in which n is a natural whole number strictly greater than 1, for example n=2 or n=3 or n=4 or n=5.

A movement according to the invention is defined by point 12 as follows:

12. A clockwork movement including a module as defined in one of points 1 to 11.

A timepiece according to the invention is defined by point 13 as follows:

13. A timepiece, in particular a wristwatch, including a module as defined in one of points 1 to 11 or a movement as defined in the preceding point.

A method for manufacturing a system according to the invention is defined by point 14 as follows:

14. A method for manufacturing a clockwork system, notably a clockwork movement or a timepiece, including a plate or a bridge, the method comprising the following steps:

- Supplying a finished or assembled or pre-assembled module as defined in one of points 1 to 11,
- Attaching the module to the plate or to the bridge, notably by driving in or by screwing or by welding or by riveting.

A system according to the invention is defined by point 15 as follows:

15. A clockwork system obtained by carrying out the manufacturing method as defined in point 14.

The attached drawings show four embodiments of a clockwork module according to the invention, by way of example.

Figure 1:
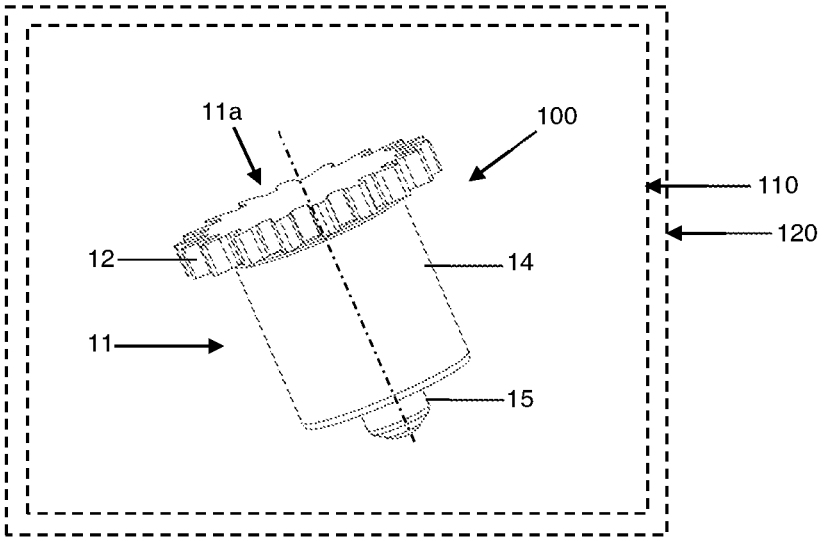
FIGS. 1 to 5 show a first embodiment of the clockwork module according to the invention.

A first embodiment of the clockwork module 100 according to the invention is described below with reference to FIGS. 1 to 5. FIG. 1 shows a timepiece 120 according to the invention. This timepiece is for example a wristwatch. The timepiece includes a clockwork movement 110, notably a mechanical clockwork movement. The clockwork movement includes the clockwork module 100 according to the first embodiment.

The clockwork module 100 includes:

- a mobile part 11 including a first functional part 11*a*, a second functional part 11*b* and a translational and/or rotational arbor 15 of the mobile part 11, the arbor having a first axis 151,
- a spring 13, notably a helical spring,
- a casing 14 including a housing 140 having a second axis 141,
- a first guide surface 140*a* in the housing 140,
- a second guide surface 14*a* in the housing 140,
- a first stop 140*b* in the housing,
- a second stop 16*b* arranged on the mobile part 11, the arbor 15 being guided by at least the first guide surface or the second guide surface, the spring 13 being arranged, notably having been pre-stressed, in the housing 140 bearing between or against the first and second stops.

In the first embodiment, the mobile part 11 has a first functional part 11*a* that includes a wheel 12. The wheel is arranged at a first end of the arbor 15. The mobile part 11 also has a second functional part 11*b*. In this case, the second functional part is a shape 15*b* of the arbor. This shape is located at a second end of the arbor 15. The shape may be domed. This shape may be used to transmit axial movement forces of the mobile part along the axis 151 of the arbor, as detailed below.

Such a mobile part 11 is, for example, provided inside a clutch device, notably a vertical clutch device, of a mechanism, in particular a correction mechanism, of a timepiece. The mobile part then has a first axial position in which same is clutched to a kinematic train and a second axial position in which same is unclutched from the kinematic train. As such, the first functional part can be used to effectively connect the mobile part and the second functional part can be used to activate or deactivate the clutching by moving the mobile part in order to position the first functional part as desired.

The arbor 15 can also be a rotational and/or translational arbor of the mobile part, i.e. the mobile part is guided in rotation and/or in translation by the arbor. Notably, this guidance may only be provided by one portion of this arbor.

The arbor 15 is for example a rotationally symmetrical cylinder. The first functional part and/or the second functional part may be integral with the arbor. Consequently, the following assemblies:

- arbor, first functional part and second functional part, or
- arbor and first functional part, or
- arbor and second functional part, may be single-piece parts. Notably, the wheel 12 can be arbor-mounted, as shown in FIGS. 1 to 4.

The housing 140 formed in the casing includes a first hole 140 and a second hole 14*a*. The first and second holes are for example coaxial and/or rotationally symmetrical. The first hole has a first guide surface 140*a*. This first guide surface is for example simply a portion of the first hole 140. The second hole has a second guide surface 14*a*. This second guide surface is for example simply all or a portion of the second hole. Both the first and second guide surfaces are arranged to cooperate directly or indirectly with a surface of the arbor 15 to perform the guide function. The diameter of the second hole is less than the diameter of the first hole. Thus, the first and second holes are connected by a shoulder 140*b* at the bottom of the first hole. The housing 140 can also contain the spring 13.

The casing has an outer surface 14*c* preferably forming a rotationally symmetrical cylinder. This surface may be coaxial with either or both of the first and second holes. The casing may therefore be a bushing.

The spring 13 is a helical spring in this case. The spring is arranged between the first stop and the second stop, notably against the first and second stops. The spring may be pre-stressed between the first and second stops. Alternatively, the spring may be mounted in the casing without pre-stressing. The spring may nonetheless be pre-stressed when the module is assembled in a system for which same is intended, such as a blank, a plate or a bridge. In this case, an element surrounding the clockwork module is used to pre-stress the spring. In the clockwork module, the spring is used in all cases to return the mobile part to an idle position, notably an axial idle position.

The first stop is or includes the shoulder 140*b* formed at the bottom of the hole.

The second stop is formed on the arbor. For example, said stop may be formed by a ring 16 mounted on the arbor. This ring may notably be driven into the arbor. In particular, said ring may be driven in until contact is made with a shoulder formed on the arbor. Alternatively, the ring may be attached to the arbor using any other means. In the embodiment shown in FIGS. 1 to 4, the ring also has an outer surface 16*a* cooperating with the first hole 140*a* to guide the mobile part in relation to the casing.

Alternatively, the second stop may be a flange formed on the arbor. The spring 13 is mounted between these first and second stops. As such, the spring 13 is contained within the casing.

Figure 2:
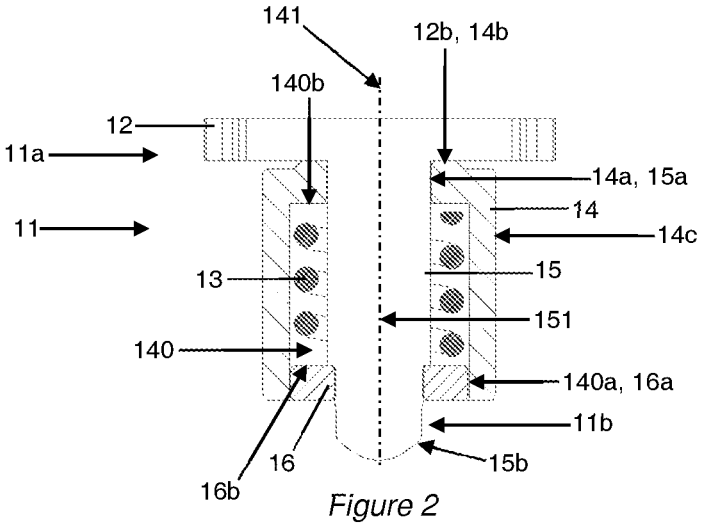

The wheel 12, the arbor 15 and the spring 13 are in this case delimited axially in relation to the bushing 14 by the ring 16 attached to the arbor 15 at one end of the mobile part 11 opposite the end of the wheel 12. The spring 13 can therefore be kept pre-stressed, such that the portion 12*b* of the wheel 12 can naturally be kept pressed against a third stop 14*b* provided on the casing under the effect of the spring 13, as shown in FIG. 2. The third stop is for example formed by a portion 14*b* of the bushing 14. As such, the casing 14 includes a third stop 14*b* arranged to stop the mobile part from moving in translation.

Figure 3:
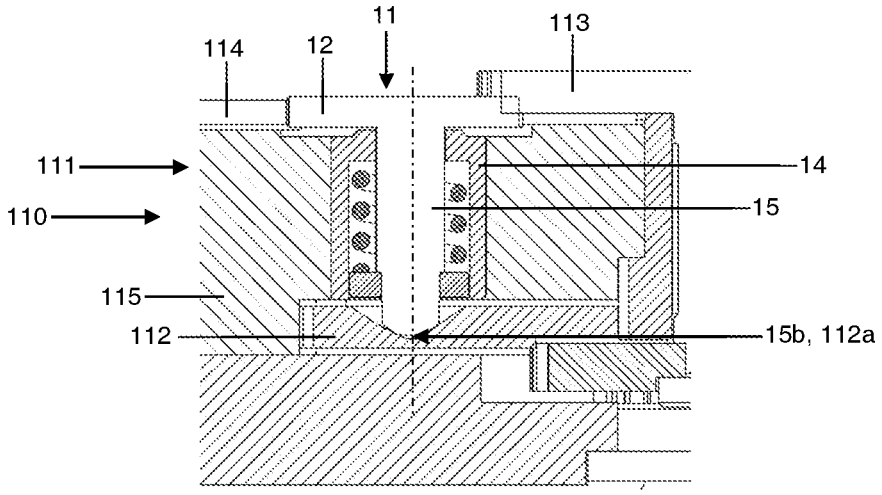
Figure 4:
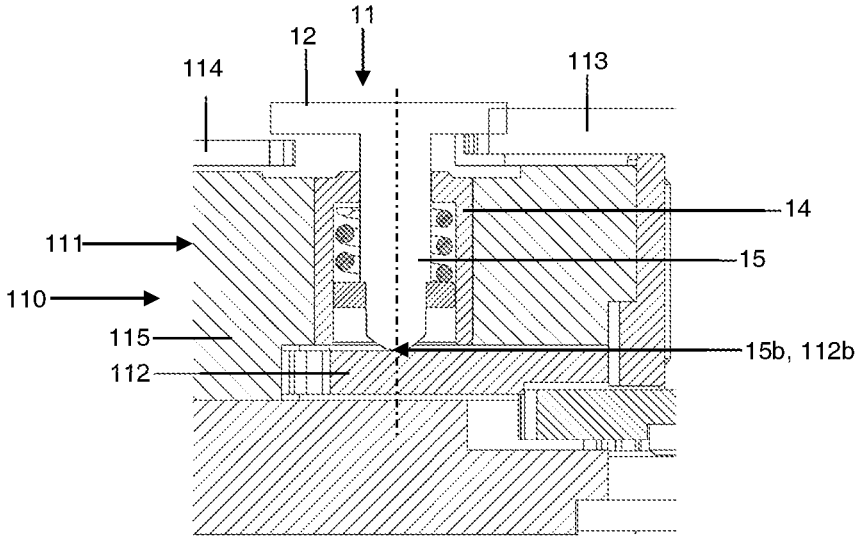

As detailed previously, in this first embodiment, the mobile part 11 has a second functional part 11*b* located at a end opposite the end with the first functional part 11*a*. This second functional part is the end 15*b* of the arbor 15. In this case, in which the mobile part 11 is for example provided inside a clutch device 111, as shown in FIGS. 3 and 4, this second functional part may be provided to cooperate with a control cam 112 of a correction mechanism 110. In this case, the bushing 14 is driven into a blank 115, notably into a plate 115. For this purpose, the bushing 14 has a portion 14*c* designed to be driven into a hole of the plate 115. Alternatively, the bushing 14 may be riveted, screwed or welded into a hole in the plate 115. As such, the casing includes an attachment element for attaching same to a plate or a bridge, notably an external rotationally symmetrical cylindrical surface of the casing designed to cooperate with a guide and/or a driving surface of a plate or of a bridge and/or one or more attachment holes formed in the casing and designed to cooperate with attachment screws or rivets. FIG. 3 shows the clutch device 111 in the clutched position. In this arrangement, the end 15*b* is arranged in a hollow 112*a* of the control cam 112, such that the toothing of the wheel 12, which is continuously in mesh with the toothing of a second setting wheel 113, can mesh with the toothing of a third setting wheel 114. FIG. 4 shows the clutched device 111 in the unclutched position. In this arrangement, the end 15*b* bears against a surface 112*b* of the control cam 112, such that the toothing of the wheel 12 is outside the range of the toothing of the wheel 114. The wheel 12 can nonetheless preferably remain in mesh with the second setting wheel 113.

Advantageously, the control cam 112 may be a control stem implementing a setting and/or winding mechanism, such as the one described in patent application WO2012175595.

Figure 5:
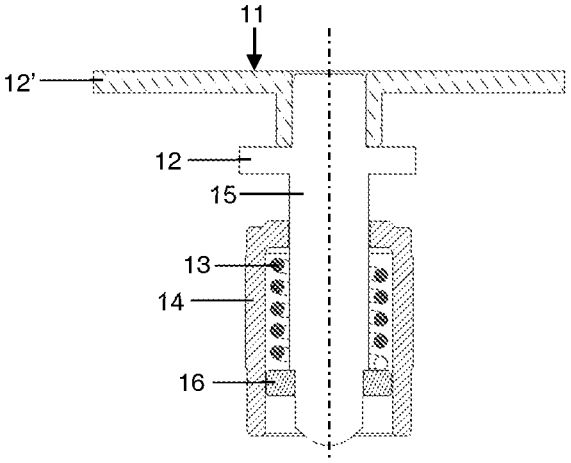

Naturally, the first functional part 11*a* of the mobile part 11 may comprise more than one wheel. By way of example, FIG. 5 shows a variant of the first embodiment of the clockwork module that differs from the subject matter described above in that the mobile part 11 has two wheels 12, 12', each of which is designed to actuate a specific kinematic setting train. For example, the wheel 12 may be arbor-mounted or integral with the arbor 15. The wheel 12' may be attached to the arbor 15, notably driven into the arbor 15. Alternatively, the elements 12 or 12' may be limited to a toothed sector.

Figure 6:
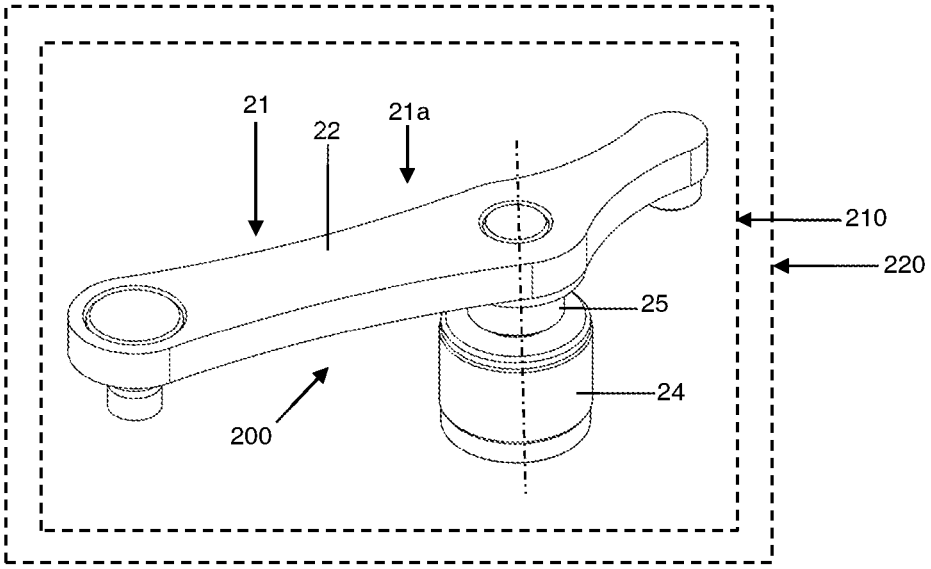
FIGS. 6 to 9 show a second embodiment of the clockwork module according to the invention.

A second embodiment of the clockwork module 200 according to the invention is described below with reference to FIGS. 6 to 9. FIG. 6 shows a timepiece 220 according to the invention. This timepiece is for example a wristwatch. The timepiece includes a clockwork movement 210, notably a mechanical clockwork movement. The clockwork movement includes the clockwork module 200 according to the second embodiment.

In the first and second embodiments, the reference signs for elements that are identical or that perform the same function only differ in the first digit: a "1" for the elements in the first embodiment and a "2" for the elements in the second embodiment.

Advantageously, the second embodiment has the following features.

Figure 7:
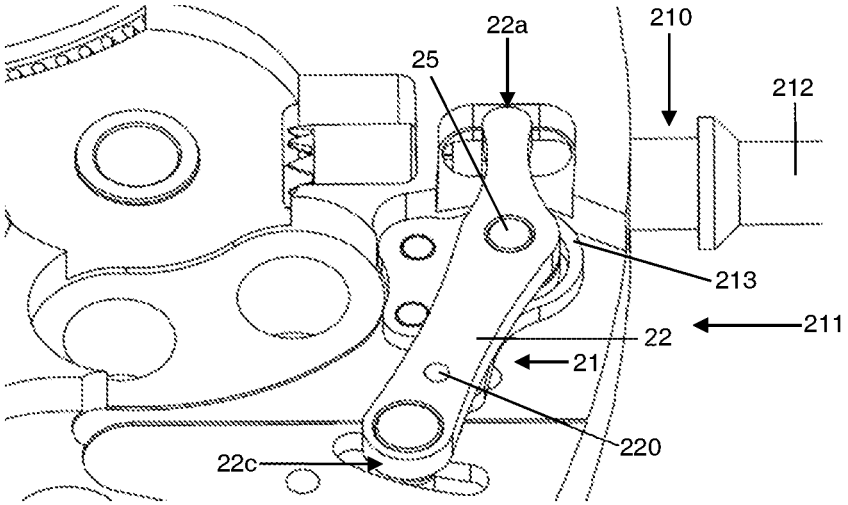
Figure 8:
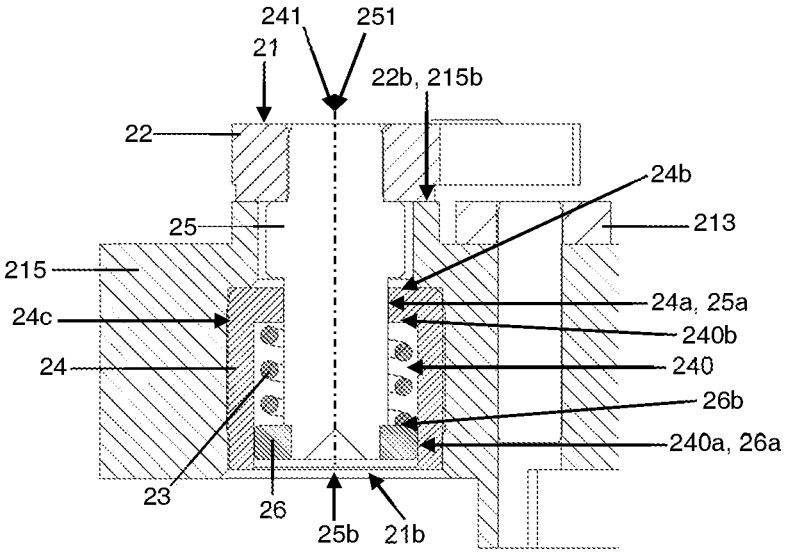
Figure 9:
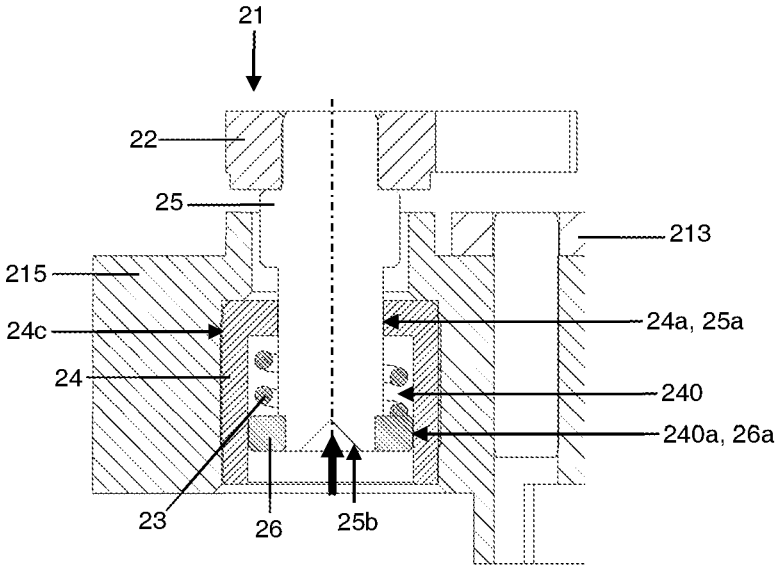

The clockwork module 200 includes a mobile part 21 that has a first functional part 21*a* that includes a yoke 22, notably a pull-out piece 22, as shown in FIG. 6. Such a mobile part is for example provided in a stem correction mechanism of a timepiece, as shown in FIGS. 7 to 9. In this embodiment, the pull-out piece 22 also includes a helical spring 23 contained in the housing 240 of a bushing 24, as shown in FIGS. 8 and 9. This pull-out piece 22 also includes an arbor 25 pivoting inside the bushing 24 at the respective portions 25*a*, 24*a* of the axis and of the bushing. A surface 24*a* of a second hole of the housing cooperates with a surface 25*a* of the arbor 25 to guide the arbor 25 into the bushing.

In this embodiment, the ring 26 also delimits the pull-out piece 22 axially in relation to the bushing 24. Advantageously, the arbor 25 may be guided, additionally or alternatively, within the inner wall 240*a* of the housing 240 of the bushing 24 by the outer periphery 26*a* of the ring 26. Thus, a surface 240*a* of a first hole of the housing cooperates with a surface 26*a* of a ring 26 attached to the arbor to guide the arbor 25 into the bushing.

Such an embodiment advantageously enables a conventional pull-out piece structure, such as the one disclosed in document EP0063543, to be replaced. FIG. 7 shows a stem correction mechanism 210, notably a pull-out piece mechanism 211. Conventionally, a first end 22*a* of the pull-out piece 22 is designed to cooperate with a stem 212, while a second end 22*c* is designed to cooperate with a lever (not shown) of the correction mechanism. In this case, the pull-out piece 22 is positioned in the plane of the frame of the movement by a return spring 213 by means of a pin 220 of the setting mechanism 22.

FIGS. 8 and 9 are cross sections of the mobile part 21 built into such a correction mechanism. In this case, the bushing 24 is driven into a blank 215, notably into a plate 215. For this purpose, the bushing 24 has a portion 24*c* designed to be driven into a hole in the plate 215. Alternatively, the bushing 24 may be riveted, screwed or welded into a hole in the plate 215.

Since in this case the spring 23 is kept pre-stressed inside the clockwork module 200, the portion 22*b* of the pull-out piece 22 naturally tends to be pressed against a portion 215*b* of the plate 215 under the effect of the spring 23, as shown in FIG. 8.

In this second embodiment, the mobile part 21 has a second functional part 21*b* located at the end opposite the end of the first functional part 21*a*. This latter is a beveled cut-out 25*b* in the arbor 25 that is designed to cooperate with a watchmaker's point shown as an arrow in FIG. 9, to enable the stem 212 to be disassembled, for example. When disassembling the pull-out piece, the portion 22*b* of the pull-out piece 22 can no longer rest against the portion 215*b*, as shown in FIG. 9.

In both the first and second embodiments, the wheel 12 and the pull-out piece 22 have a degree of freedom in translation along the arbor 15, 25, for example in a direction substantially perpendicular to the plane of the frame of the movement. Naturally, a clockwork module could include a mobile part with a degree of freedom in translation in a different direction, for example a direction substantially parallel to the plane of the frame of the movement.

Figure 10:
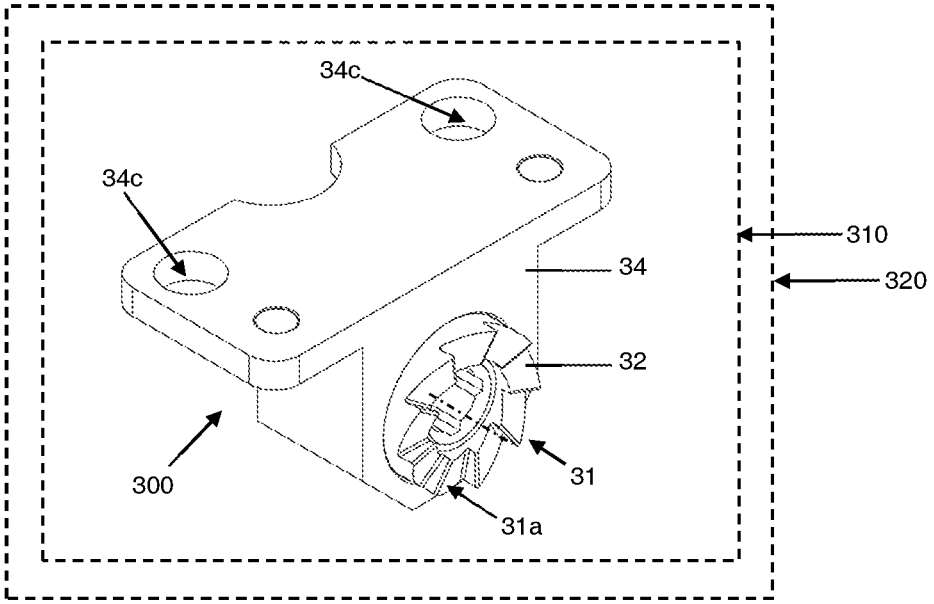
FIGS. 10 to 12 show a third embodiment of the clockwork module according to the invention.
Figure 11:
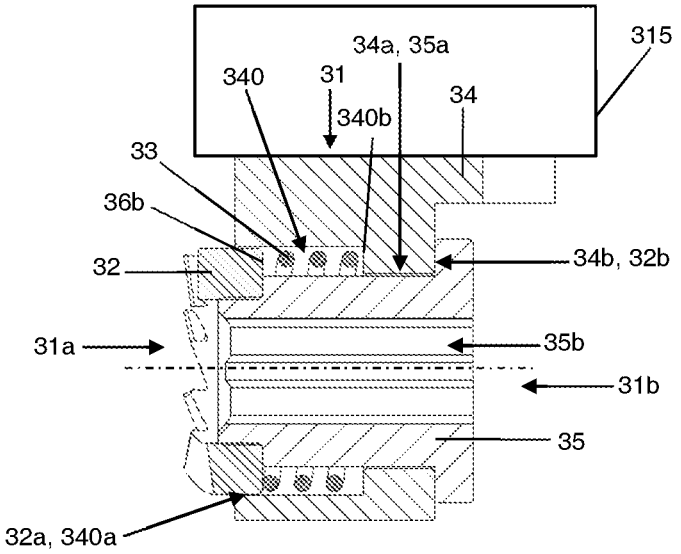
Figure 12:
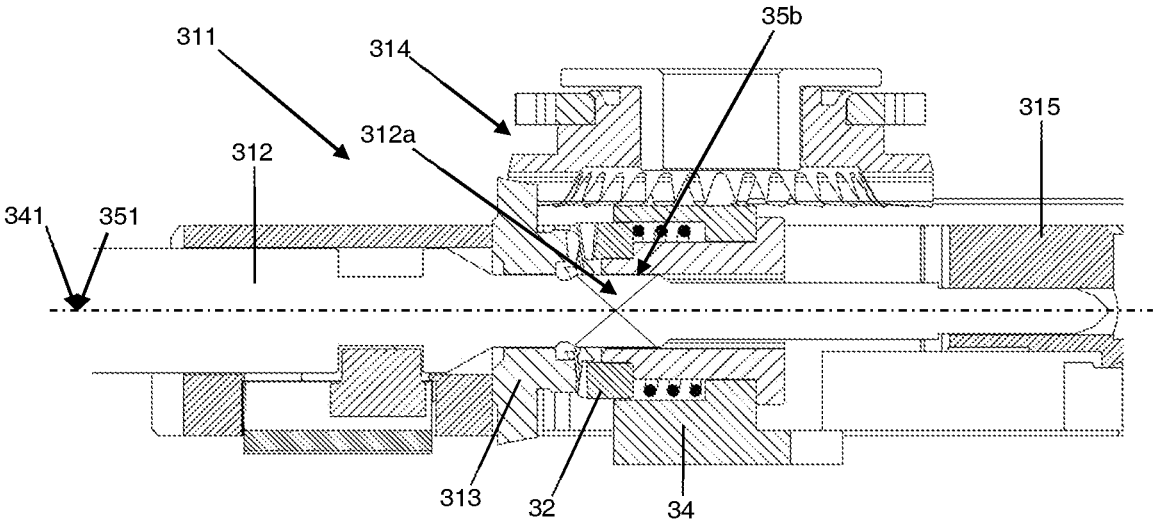

A third embodiment of the clockwork module 300 according to the invention is described below with reference to FIGS. 10 to 12. FIG. 10 shows a timepiece 320 according to the invention. This timepiece is for example a wristwatch. The timepiece includes a clockwork movement 310, notably a mechanical clockwork movement. The clockwork movement includes the clockwork module 300 according to the third embodiment.

In the first and third embodiments, the reference signs for elements that are identical or that perform the same function only differ in the first digit: a "1" for the elements in the first embodiment and a "3" for the elements in the third embodiment.

Advantageously, the third embodiment has the following features.

In this third embodiment, the clockwork module 300 includes a mobile part 31 including, in the vicinity of the first functional part 31*a*, a winding pinion 32 designed to be built into the clutch device 311 of a winding train of a mechanism 310.

In particular, the module 300 includes a bridge 34 in the form of a stretcher that is designed to be screwed to a plate 315. As such, in this third embodiment, the casing is a bridge.

Apart from the geometry of the casing 34, the structure of the mobile part 31 is similar to the structure of the mobile parts 11 and 21. In this third embodiment, the winding pinion 32 is positioned axially by a spring 33 that is contained within a housing 340 of the bridge 34. In this case, the spring 33 acts directly against the pinion 32. This latter is driven into an arbor 35, which may be designed to pivot at the respective portions 34*a*, 35*a* of the bridge and of the arbor. As such, the surfaces 34*a* and 35*a* cooperate to guide the arbor into the housing 340. Advantageously, the arbor 35 may be guided, additionally or alternatively, within the inner wall 340*a* of the housing 340 of the bridge 34 by the outer periphery 32*a* of the pinion 32. This latter is also delimited axially at the respective portions 34*b*, 32*b* of the bridge and of the arbor, which are naturally held in contact under the effect of the spring 33.

The mobile part 31 also includes a second functional part 31*b*. This latter is a non-circular axial cut-out 35*b* in the arbor 35 that is designed to cooperate with a square portion 312*a* of a stem 312 of the clutch device 311 when the movement winding function is actuated, as shown in FIG. 12.

In this case, the spring 33 provides the pinion 32 with a degree of freedom in translation when the square portion 312*a* of the stem 312 enters the cut-out 35*b* in the arbor 35, thereby enabling the Breguet toothing of the winding pinion 32 to mesh, without risk of blocking, with the toothing of the second winding pinion 313, simply pivoted on the winding stem, which is in mesh with a winding crown 314.

Figure 13:
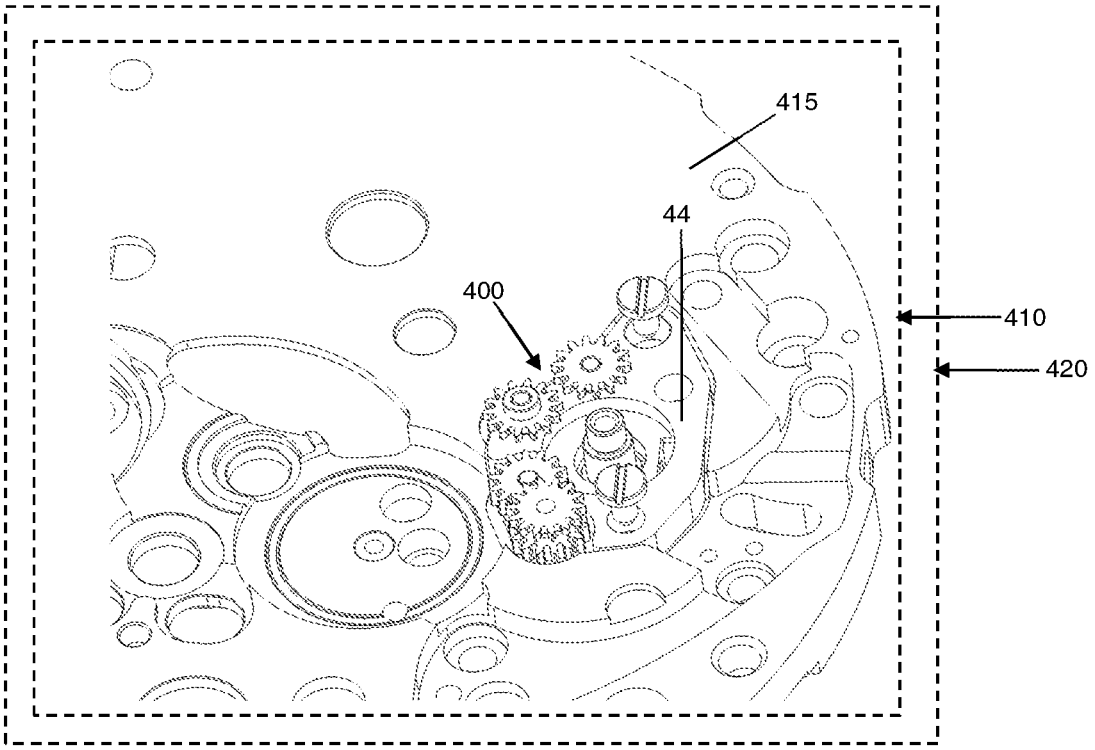
FIGS. 13 to 14 show a fourth embodiment of the clockwork module according to the invention.
Figure 14:
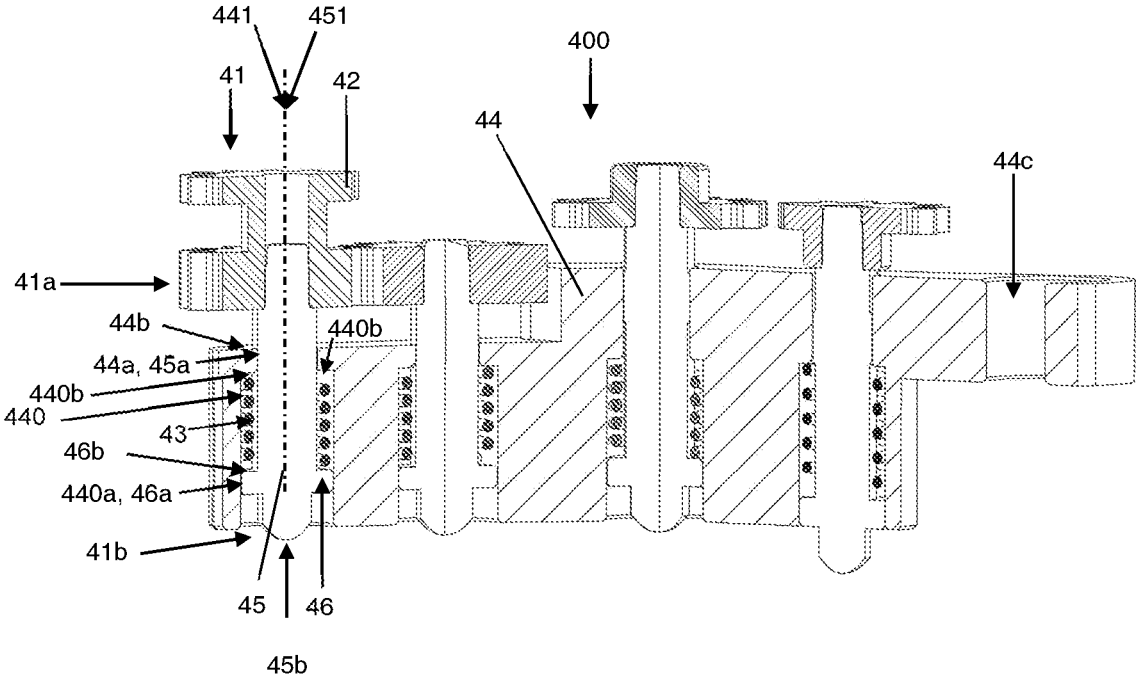

A fourth embodiment of the clockwork module 400 according to the invention is described below with reference to FIGS. 13 and 14. FIG. 14 shows a timepiece 420 according to the invention. This timepiece is for example a wristwatch. The timepiece includes a clockwork movement 410, notably a mechanical clockwork movement. The clockwork movement includes the clockwork module 400 according to the fourth embodiment.

In the first and fourth embodiments, the reference signs for elements that are identical or that perform the same function only differ in the first digit: a "1" for the elements in the first embodiment and a "4" for the elements in the fourth embodiment.

Advantageously, the fourth embodiment has the following features.

In this fourth embodiment, the clockwork module 400 includes a plurality of mobile parts 41. For example, the different mobile parts 41 have wheels 42, notably wheels making up portions of different kinematic trains. If the clockwork module 400 has n mobile parts, it consequently also has n springs 43, n housings 440, n first guide surfaces 44*a, n* second guide surfaces 440*a, n* first stops 440*b* in the housing, and n second stops 46*b*, but only one casing 44. n is a whole natural number. In FIGS. 13 and 14, n=4. In FIGS. 13 and 14, the casing is a bridge. The bridge includes screw holes as attachment elements for attaching same to a plate 415.

In the fourth embodiment, the wheels 42 are attached to the arbors 45 and the flanges 46 are integral with the arbors 45.

In the fourth embodiment described, all of the first functional parts have wheels 42 and therefore perform identical or similar functions. Alternatively, this need not be the case. Different first functional parts may perform different functions. For example, a first functional part may have a wheel, another first functional part may have a yoke or a lever, another functional part may have a cam, a follower or a jumper head.

Regardless of embodiment, the mobile part may include a functional part, such as a wheel, that is pivoted eccentrically in relation to the axis of the arbor and to the axis of translation and/or of rotation of the arbor in the casing.

Regardless of embodiment, the clockwork module is provided to overcome the drawbacks of the mobile parts known in the prior art. The clockwork module is noteworthy in that it contains a return spring as well as guide and assembly means.

This embodiment is particularly advantageous as it is simple to implement and assemble in the movement. Thus, the clockwork module is a pre-assembled module that is ready to be attached to a blank of a clockwork movement. Such a solution helps to reduce the volume of a clockwork mechanism incorporating such a mobile part. Furthermore, the return spring may be pre-stressed independently of assembly of the mobile part inside the movement. This considerably simplifies assembly of same in the movement.

Regardless of embodiment, the clockwork module is particularly advantageous as it is simple to implement and assemble in the clockwork movement. In addition to the presence of a mobile part or of a clockwork component 12, 22, 32, 42, which is designed to actuate a second clockwork component of a mechanism 110, 210, 310, 410, the module is characterized by return elements 13, 23, 33, 43 contained within a bushing or a bridge 14, 24, 34, 44 that is designed to be assembled on a blank 115, 215, 315, 415.

The mobile parts 11, 21, 31, 41 have at least one first degree of freedom in translation in a direction preferably substantially perpendicular or parallel to the plane of the frame of the movement. Advantageously, the mobile parts 11, 21, 31, 41 have at least one second degree of freedom in rotation. Optionally, the mobile parts have at least one second functional part 11*b*, 21*b*, 31*b*, 41*b* that is designed to cooperate with a mechanism of the clockwork movement or with a tool used when assembling or disassembling the clockwork movement.

Advantageously, the axial travel of the mobile part 11, 21, 31, 41 is less than the axial length of the casing 14, 24, 34, 44. Advantageously, the return means are helical springs 13, 23, 33, 43.

In the different embodiments described, the clockwork module includes a mobile part pivoted in the casing. Nonetheless, the clockwork module may alternatively include a mobile part that only has a sliding connection in the casing. This may notably be the case of a mobile part acting as a jumper head or a finger, for example a position indexing finger or a cam follower.

The invention also relates to a method for manufacturing a clockwork system including a plate or a bridge, notably a clockwork movement 110; 210; 310; 410 as described above or a timepiece 120; 220; 320; 420 as described above.

The method includes the following steps:

Supplying a finished or assembled or pre-assembled clockwork module, as described above, Attaching the clockwork module to the plate or to the bridge, notably by driving in or by screwing or by welding or by riveting.

The invention also relates to a clockwork system 110; 210; 310; 410; 120; 220; 320; 420 obtained by carrying out the manufacturing method described above.

The invention claimed is:

1. A clockwork module including:

a mobile part including (i) at least a first functional part of a clockwork movement, and (ii) an arbor, the arbor being integral with the first functional part or attached to the first functional part, the arbor having a first axis, the first functional part being adapted to transmit at least one selected from the group of a translational movement and a rotational movement to another component of the clockwork mechanism, a spring, a casing including a housing having at least one second axis, a first guide surface in the housing, a first stop in the housing, and a second stop arranged on the mobile part, the spring being arranged in the housing between the first and second stops, the arbor of the mobile part being guided by at least the first guide surface of the housing and being movable between a first functional position of the mobile part and a second position different translationally from the first position along a length of the second axis of the housing, wherein the arbor has a second functional part located opposite the first functional part relative to the second stop along the first axis, and accessible from outside the housing.

2. The module as claimed in claim 1, wherein the first functional part includes or is a member acting by at least one selected from the group consisting of translation along the second axis and rotation about the second axis.

3. The module as claimed in claim 1, wherein the first axis and the second axis are coaxial or substantially coaxial.

4. The module as claimed in claim 1, wherein the second stop is formed by shaping the arbor.

5. The module as claimed in claim 4, wherein the arbor has a shape that has an outer surface cooperating with the first guide surface of the housing.

6. The module as claimed in claim 4, wherein the arbor is shaped by means of a flange integral with the arbor or a ring attached to the arbor.

7. The module as claimed in claim 6, wherein the arbor is shaped by means of a ring driven into the arbor.

8. The module as claimed in claim 1, wherein the housing has a first hole that is blind and a second hole that is open.

9. The module as claimed in claim 1, wherein the casing includes an attachment element for attaching the casing to a plate or a bridge.

10. The module as claimed in claim 1, including a third stop on the casing arranged to stop the mobile part from moving in translation along the second axis.

11. The module as claimed in claim 1, wherein the casing is a bushing or a bridge.

12. A clockwork movement including a module as claimed in claim 1.

13. A timepiece including the module as claimed in claim 1.

14. A method for manufacturing a clockwork system including a plate or a bridge, the method comprising:

supplying the finished or assembled or pre-assembled module as claimed in claim 1, and attaching the module to the plate or to the bridge.

15. The clockwork system obtained by carrying out the manufacturing method as claimed in claim 14.

16. The module as claimed in claim 1, wherein the spring is a helical spring.

17. The module as claimed in claim 1, wherein the spring is arranged by having been pre-stressed in the housing between the first and second stops.

18. The module as claimed in claim 1, wherein the first functional part includes or is a member acting by translation along the second axis.

19. The module as claimed in claim 1, wherein the arbor of the mobile part is resiliently guided by the spring toward at least one of the first functional position of the mobile part and the second position.

20. The module as claimed in claim 1, wherein the first functional part includes or is a member selected from the group consisting of a toothed wheel, a toothed sector, a yoke, a lever, a follower, a jumper head, a pull-out piece having an eccentric portion relative to the arbor, and a cam.

21. The module as claimed in claim 1, wherein the second functional part includes or is a shape designed to receive or to transmit a force along the second axis so as to move the arbor of the mobile part from the first functional position of the mobile part to the second position different translationally from the first position along the length of the second axis of the housing.

22. The module as claimed in claim 1, wherein the arbor is (i) integral with the second functional part, or (ii) attached to the second functional part.

23. The module as claimed in claim 1, wherein the second functional part includes or is a shape designed to receive or to transmit a force along the second axis, wherein the shape is selected from a domed shape of the arbor, a concave shape of the arbor, a throughout cut-out in the arbor, and a wheel having toothing designed to transmit a force along at least one selected from the group consisting of the first axis and the second axis.

24. The module as claimed in claim 1, wherein the first stop is or includes a shoulder in the housing.

25. The A clockwork module as claimed in claim 1, including:

n mobile parts, each including (i) a first functional part of a clockwork movement and (ii) at least one selected from the group consisting of a translational arbor and a rotational arbor of the mobile part, the arbor being integral with the first functional part or attached to the first functional part, the arbor having a first axis, each of the first functional parts being adapted to transmit at least one selected from the group of a translational movement and a rotational movement to another component of the clockwork mechanism, n springs, a single casing including n housings, each having a second axis, n first guide surfaces in the housings, n first stops in the housings, and n second stops arranged on the mobile parts, the n arbors being guided by at least the first guide surfaces, the n springs being arranged in the housings between the first and second stops, in which n is a natural whole number strictly greater than 1, the arbor of each of the mobile parts being guided by at least the first guide surface of the housing between a first functional position of the mobile part and a second position different translationally from the first position along the second axis of the housing, wherein, in at least one of the n mobile parts, the arbor has a second functional part located opposite the first functional part relative to the second stop along the first axis, and accessible from outside the housing.

26. The clockwork module as claimed in claim 25, wherein each of the n other mobile parts includes a second functional part located opposite the first functional part relative to the second stop along the first axis, and accessible from outside the housing.

* * * * *